United States Patent [19]

Pido

[11] Patent Number: 4,652,021

[45] Date of Patent: Mar. 24, 1987

[54] QUICK-ACTION COUPLING FOR AN EXTENSION TUBE USED IN OIL-WELL DRILLING

[75] Inventor: Jean-Claude Pido, Le Creusot, France

[73] Assignee: Creusot-Loire, Paris, France

[21] Appl. No.: 685,178

[22] Filed: Dec. 21, 1984

[30] Foreign Application Priority Data

Dec. 23, 1983 [FR] France ..... 83 20675

[51] Int. Cl.[4] ..... F16L 37/08

[52] U.S. Cl. ..... 285/81; 285/421; 285/912; 285/377; 285/401; 285/362

[58] Field of Search ..... 285/39, 90, 377, 360, 285/361, 362, 396, 401, 402, 421, 81, 86, 308, 309, 330, 912

[56] References Cited

U.S. PATENT DOCUMENTS

| | | | |
|---|---|---|---|
| 3,472,538 | 10/1969 | Vincent et al. | 285/421 |
| 4,068,865 | 1/1978 | Shanks | 285/90 |
| 4,278,278 | 7/1981 | Chambless et al. | 285/361 |
| 4,280,719 | 7/1981 | Daniel et al. | 285/90 |
| 4,330,140 | 5/1982 | Hampton | 285/90 |

FOREIGN PATENT DOCUMENTS

| | | | |
|---|---|---|---|
| 108566 | 1/1968 | Denmark | 285/401 |
| 2526517 | 11/1983 | France | 285/402 |

*Primary Examiner*—Cornelius J. Husar
*Assistant Examiner*—Eric K. Nicholson
*Attorney, Agent, or Firm*—Pollock, Vande Sande & Priddy

[57] ABSTRACT

Quick-action coupling for the elements of an extension tube used in ocean oil well drilling, comprising a female tubular element (3) and a male tubular element (4) of the rising column. When fitted into another, these form between them an annular groove (10) open in its upper part and limited in its lower part by an axial bearing surface made on the periphery of one of the tubular elements (3, 4), this having a dimension sufficient to allow the locking collar (13) to be introduced.

4 Claims, 2 Drawing Figures

2
22
7
20
23
21
24
16
15
8
10
12
3
13
14
4
11
6
5
6
1

2
22
7
20
21
23
30
24
16
15
8
10
12
3
13
14
4
11
6
5
6
1

QUICK-ACTION COUPLING FOR AN EXTENSION TUBE USED IN OIL-WELL DRILLING

FIELD OF THE INVENTION

The present invention relates to a quick-action coupling particularly for the elements of an extension tube used for oil well drilling in the ocean.

BACKGROUND OF THE INVENTION

The off-shore drilling of oil and gas wells in the ocean bottom is carried out from fixed or floating platforms or floating vessels. To carry out these operations, it is necessary to connect the drilling platform located at the surface to the ocean bottom by means of an extension tube, often called a "riser". This tube, consisting of numerous elements joined together end to end, serves mainly for channeling the drilling mud and guiding the drill rods.

To connect these elements, couplings of the bayonet type are used, and these incorporate a locking collar arranged outside the elements of the extension tube which are to be connected.

SUMMARY OF THE INVENTION

The invention proposes a quick-action coupling comprising a female tubular element and a male tubular element which fit into one another, a locking collar provided with a ring of lugs which interacts with a ring of lugs provided on one of the tubular elements, and members intended for exerting in the axial direction a clamping pre-stress between the two tubular elements and the locking collar, wherein the female tubular element and the male tubular element form between them an annular groove open in its upper part and limited in its lower part by an axial bearing surface made on the periphery of one of the tubular elements, the said groove having a sufficient dimension to allow the locking collar to be introduced.

BRIEF DESCRIPTION OF THE DRAWINGS

The invention will now be explained by way of example, with reference to the attached drawings in which.

DETAILED DESCRIPTION

Figure 1:
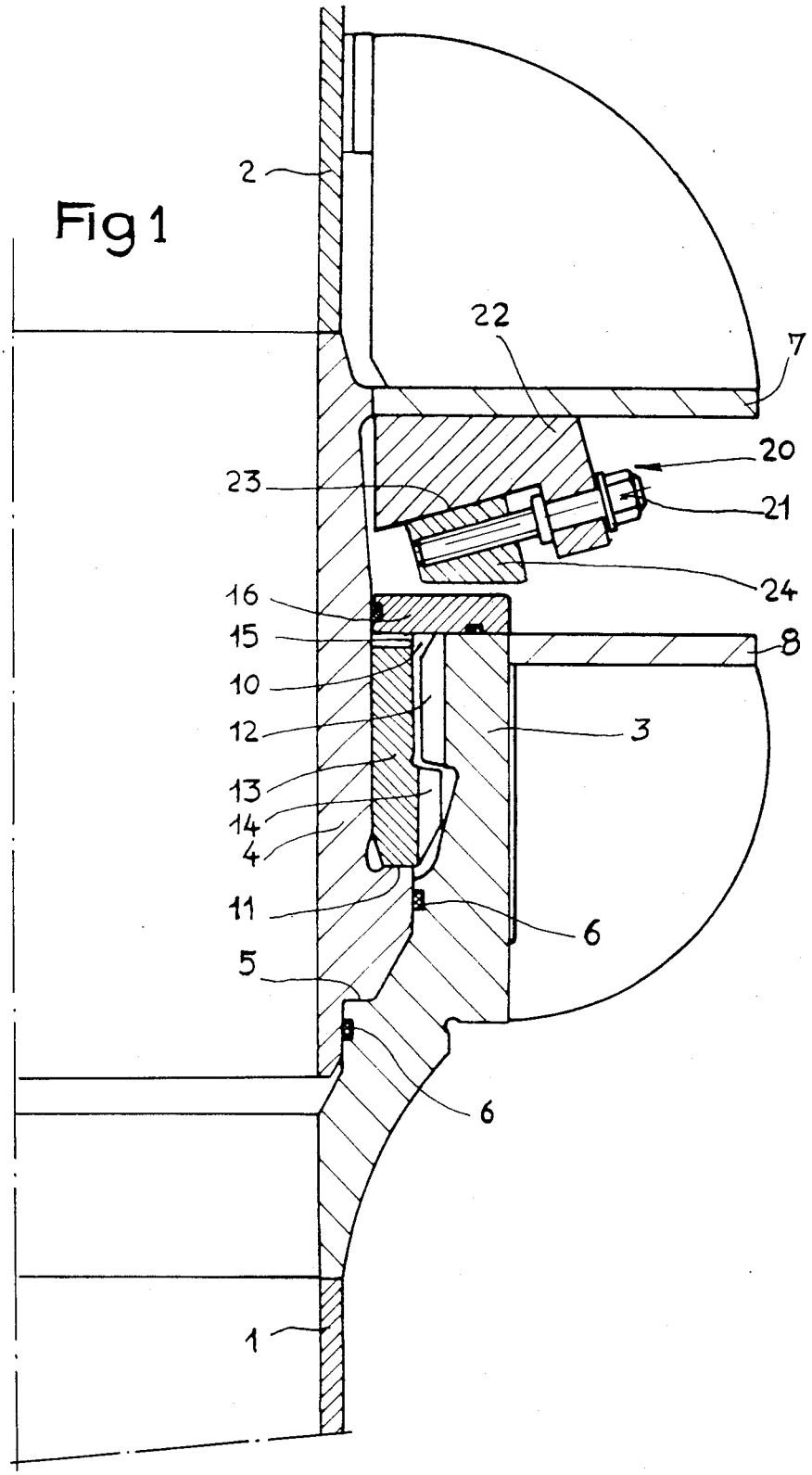
FIG. 1 is a view in vertical section of the coupling according to the invention in its unlocked postion.

The figures, showing an example of a quick-action coupling according to the invention for an extension tube used in oil well drilling in the ocean, illustrate the lower part 1 and the upper part 2 of the extension tube, to which the two tubular elements (3, 4) of the coupling are connected by any suitable means, for example by welding.

These two tubular elements (3, 4) fit into one another, this fitting being limited by a shoulder 5 provided on the inside of the female element 3 and leak-proofing being ensured by means of gaskets 6.

The tubular elements (3, 4) have flanges 7, 8 for fixing to the lower part and to the upper part of extension tube peripheral lines which equip the said tubes in an entirely conventional way.

The female tubular element 3 and the male tubular element 4 fitting into one another form between them an annular groove 10 which is limited in its lower part by an axial bearing surface 11 provided on the outer periphery of the male element 4. The female tubular element 3 possesses on the inside a ring of lugs 12. A locking collar 13 is introduced into the annular groove 10 and is provided in its lower part and on the outside with a ring of lugs 14. The upper face of the locking collar 13 has teeth 15 interacting with teeth provided underneath a washer 16 which surrounds the male tubular element 4 and which bears on the edge of the female element 3.

The coupling also possesses members designated by reference numeral 20, which are distributed uniformly around the male tubular element 4 and which ensure that the said coupling is blocked in the locked position.

Each blocking member 20 consists of a screw 21 mounted so as to rotate freely on a stay block 22 fastened underneath the flange 7. The stay block 22 has a slope 23, and the screw 21 drives in translation an oblique wedge 24 which slides between the slope and the washer 16.

The coupling is assembled and locked in the following way:

The male tubular element 4, on which the collar 13 and the washer 16 have already been placed, is fitted into the female tubular element 3 until it bears on the shoulder 5 (FIG. 1). The lugs 14 of the collar 13 pass between the lugs 12 of the female tubular element 3. The collar 13 rests on the axial bearing surface 11, and the play between the lugs (12, 14) is sufficient to allow the collar 13 to rotate freely in the annular groove 10.

Figure 2:
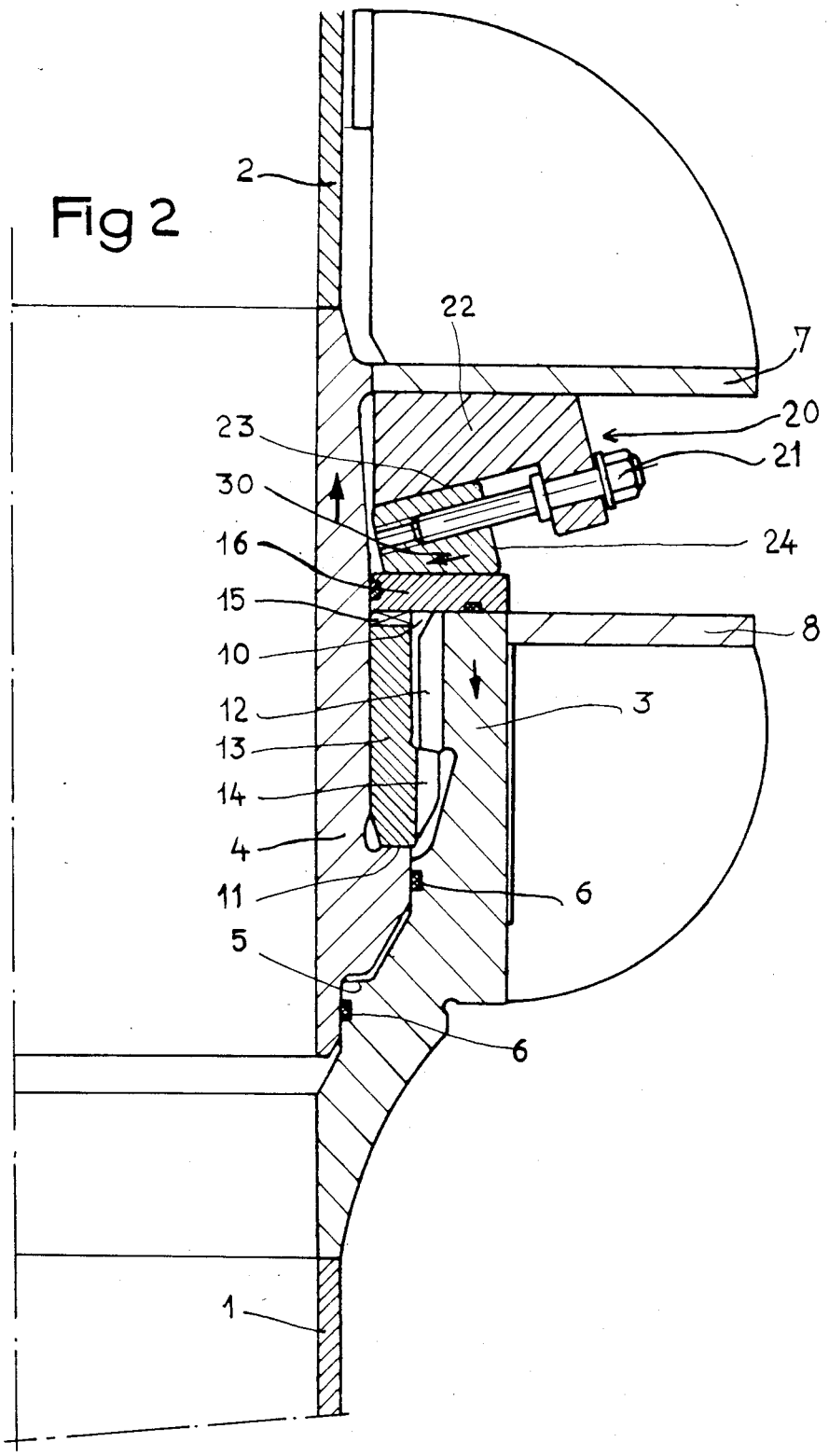
FIG. 2 is a view in vertical section of the coupling in its locked position.

Subsequently, the washer 16 is rotated a fraction of a revolution in order to drive the collar 13 in rotation by means of the teeth 15, in such a way that the lugs 14 take up position underneath the lugs 12. Since the blocking members 20 are always in place, the screws 21 are rotated in succession, thus driving the oblique wedges 24 in translation in the direction indicated by the arrow 30 in FIG. 2. As a result of the chocking effect of the oblique wedges 24, this translation exerts, on the one hand, an axial thrust directed downwards on the female tubular element 3 by means of the washer 16 and, on the other hand, an axial thrust directed upwards on the male tubular element 4 by means of the stay blocks 22 and the flange 7.

The collar 13 is chocked in the groove 10 between the two tubular elements (3, 4) and immobilized in the locking position by the rings of lugs (12, 14). The coupling is therefore locked.

Unlocking will be carried out by means of the release of the oblique wedges 24 and the uncoupling of the collar 13 as a result of rotation a fraction of a revolution.

This arrangement allows a minimum number of machining operations on the various elements and forms a compact assembly in which the rotating locking collar is well protected between two solid pieces, thus making it possible to reduce the dimensions of the collar and consequently the overall size of the coupling, while at the same time allowing easy access to the sealing gaskets. Moreover, it also permits good distribution of the load around the circumference of the tubular elements and makes it possible to check the high-stress zones very easily.

It goes without saying that modifications can be made to the embodiment which has just been described, in particular as regards the members for ensuring a clamping pre-stress, without thereby departing from the scope of the present invention.

I claim:

1. A quick-action coupling particularly for upper and lower elements of an extension tube used for marine oil well drilling, comprising a female tubular element and a male tubular element fitting into one another, a locking collar provided with a first ring of lugs, a second ring of lugs provided on one of said tubular elements interacting with said first ring of lugs, and members intended for exerting in an axial direction a clamping prestress between said two tubular elements and said locking collar, wherein the female tubular element (3) and the male tubular element (4) form between them an annular groove (10) open in its upper part and limited in its lower part by an axial bearing surface (11) formed on the periphery of one of said tubular elements (3, 4), said groove having a sufficient dimension to allow insertion of said locking collar (13) thereinto, and wherein said collar has a lower portion and an outer side, said first ring of lugs (14) being provided in said lower part and on said outer side of said collar, said second ring of lugs (12) of said female tubular element (3) having an upper part and an inner side, said second ring of lugs (12) being provided in said upper part and on said inner side of said female tubular element (3).

2. A quick-action coupling as claimed in claim 1, wherein said locking collar (13) has an upper face provided with teeth (15) interacting with teeth on a washer (16) for driving said collar in rotation.

3. A quick-action coupling as claimed in claim 2, wherein said washer (16) bears on said female tubular element (3).

4. A quick-action coupling as claimed in any one of the preceding claims, wherein the members (20) exerting the clamping prestress each consist of an oblique wedge (24) which is displaced between two bearing surfaces located opposite one another, which are respectively associated with said female element (3) by means of said washer (16) and with said male element (4) by means of a stay block (22) having a slope (23).

* * * * *